US005544712A

United States Patent [19]

McEwen et al.

[11] Patent Number: 5,544,712

[45] Date of Patent: Aug. 13, 1996

[54] DRILL PIPE BREAKOUT DEVICE

[75] Inventors: Richard McEwen, Coyle; Darrel W. Sparks, Perry, both of Okla.

[73] Assignee: The Charles Machine Works, Inc., Perry, Okla.

[21] Appl. No.: 344,653

[22] Filed: Nov. 18, 1994

[51] Int. Cl.[6] ..... E21B 19/00

[52] U.S. Cl. ..... 175/57; 166/77.51; 166/377; 166/380; 173/164; 175/320

[58] Field of Search ..... 166/77.5, 85, 380, 166/379, 377; 285/330; 175/320, 57; 173/164

[56] References Cited

U.S. PATENT DOCUMENTS

| | | | |
|---|---|---|---|
| 2,969,702 | 1/1961 | Cornish et al. | 81/53 |
| 3,291,225 | 12/1966 | Foran | 173/164 |
| 3,554,298 | 1/1971 | Klein | 173/164 |
| 3,768,579 | 10/1973 | Klein | 173/164 |
| 3,771,389 | 11/1973 | Coyne | 81/54 |
| 3,915,244 | 10/1975 | Brown | 175/85 |
| 4,030,542 | 6/1977 | Poe et al. | 166/77.5 |
| 4,037,672 | 7/1977 | Hodge | 137/157 |
| 4,147,215 | 4/1979 | Hodge et al. | 166/77.5 X |
| 4,660,634 | 4/1987 | Johnson, Jr. | 166/77.5 |
| 4,691,790 | 9/1987 | Reichman et al. | 175/67 |
| 4,762,187 | 8/1988 | Haney | 175/171 |
| 4,830,121 | 5/1989 | Krasnov et al. | 175/57 |
| 4,844,171 | 7/1989 | Russell, Jr. | 166/77.5 X |
| 5,048,621 | 9/1991 | Bailey et al. | 175/74 |
| 5,050,691 | 9/1991 | Moses | 175/57 |
| 5,267,621 | 12/1993 | Deken et al. | 175/57 |
| 5,361,831 | 11/1994 | Young | 166/77.5 |

FOREIGN PATENT DOCUMENTS

| | | | |
|---|---|---|---|
| 1479607 | 5/1989 | U.S.S.R. | 175/320 |

*Primary Examiner*—Hoang C. Dang

*Attorney, Agent, or Firm*—Richards, Medlock & Andrews

[57] ABSTRACT

A mechanism (10) is disclosed for securing a drill pipe (14) to a saver sub (16) for joint rotation. A slidable collar (24) is provided which has a pair of opposed lugs (28) which slide on opposed flats (18) on the saver sub to insure that the slidable collar rotates with the saver sub at all times. The drill pipe (14) has a pair of opposed flats (30) which are engaged by a portion of the lugs (28) when the slidable collar (24) is moved into the engaged position to insure rotation of the drill pipe with the saver sub.

5 Claims, 2 Drawing Sheets

DRILL PIPE BREAKOUT DEVICE

TECHNICAL FIELD OF THE INVENTION

This invention relates to drilling equipment, specifically horizontal boring equipment and in particular to the removal of drill pipe from a drill string.

BACKGROUND OF THE INVENTION

In drilling, it is common to extend the length of the drill string as the drill proceeds by adding individual threaded drill pipe sections to the drill string. The drilling action of the bit at the end of the drill string is usually accomplished by rotating the entire drill string in one direction continuously. The rotation is induced by a drilling unit at the surface which rotates an output shaft threaded to the last section of pipe in the drill string. Typically, the direction of rotation of the output shaft drill is the same direction that makes up the threaded connections between the individual sections of pipe and the rotation of the output shaft is therefore efficiently transferred to the drill pipe at the cutting face.

When the pipe is to be removed from the drill string after the drilling is completed, the output shaft must be operated in a reverse direction to unthread the individual pipe from the drill string. However, in the absence of external forces, it is difficult to control which of the many threaded connections will be the first broken by this reverse rotation.

To avoid this problem, particularly in the field of horizontal drilling, it is typical to provide a drill unit which has a mechanism to move the output shaft along the machine at least the length of a section of the drill pipe. To unthread the upper most section of pipe from the drill string, the output shaft is retracted so that the uppermost section of pipe is contained within the drill unit. The end of the next lower pipe is prevented from rotating with a wrench or similar locking method attached to the drill unit. The output shaft is then rotated in the reverse or unthreading direction while an additional person assists the breaking effort with a handheld pipe wrench. This method is relatively fast, but requires two people. Therefore, a need exists for improved mechanism to assist in breaking out the sections of pipe once the drilling has been completed.

One such device is disclosed in U.S. Pat. No. 5,267,621 issued on Dec. 7, 1993 and assigned to the common assignee of the present application.

SUMMARY OF THE INVENTION

In accordance with one aspect of the present invention, a mechanism is provided for securing the output shaft of the drill unit to a pipe in a drill string for rotation with the output shaft. An end of the pipe is threaded to the output shaft of the drill unit through a replaceable saver sub securely attached to the output shaft. The end of the pipe also has a pair of opposed flats. The mechanism includes a slidable collar mounted on the saver sub for sliding motion between a first position spaced from the end of the pipe and a second position extending over the end of the pipe. As the outer collar moves from the first position to the second position, the outer collar engages the opposed flats on the end of the pipe to secure the pipe for rotation with the output shaft. The saver sub has opposed flats which extend along its length while the slidable collar has opposed lugs which engage the flats through the entire rankle of motion of the slidable outer collar between the first and second positions to insure the slidable collar always rotates with the saver sub.

BRIEF DESCRIPTION OF THE DRAWINGS

For a more complete understanding of the present invention, and the advantages thereof, reference is now made to the following description taken in conjunction with the accompanying drawings, in which.

DETAILED DESCRIPTION

Figure 1:
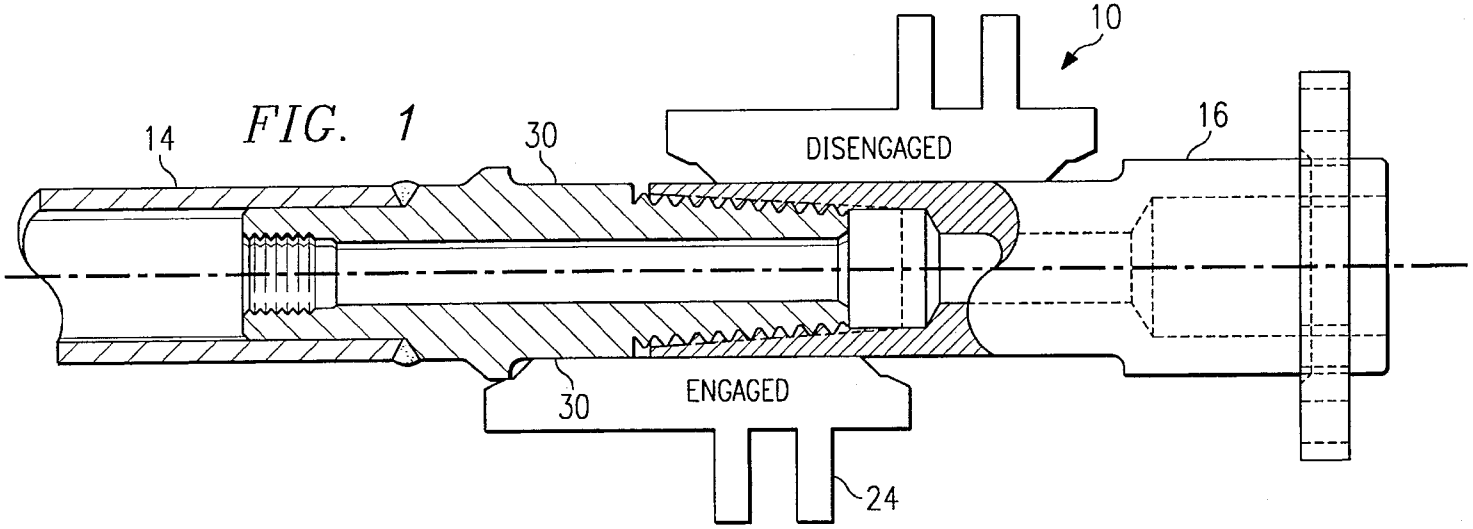
FIG. 1 is a side view in cross section of a mechanism forming a first embodiment of the present invention.

With reference now to the drawings, wherein like reference numerals designate like or similar parts throughout the several views, a mechanism 10 is illustrated which can be used on the saver sub 16 of a drill unit to assist in removal of the uppermost section of the drill pipe 14 in a drill string.

As noted previously, a drill unit will have a mechanism, not shown, to rotate an output shaft. The saver sub 16 is attached to the output shaft for rotation with it. The saver sub is replaceable, and if it wears, only the saver sub needs to be replaced rather than repairing the whole drill unit. The drill unit rotates the pipe 14 for drilling through the output shaft and saver sub 16. The drill motor is reversible so that the saver sub 16 can be rotated in a first direction for drilling and making up the threads of the various sections of pipe and in the reverse direction to break out or unthread the threaded connections in the drill pipe.

The saver sub 16 is mounted on a mechanism within the drill unit which allows the saver sub 16 to be moved along the drill unit along the axis of the drill string to advance the drill string in a manner well known in the industry. As the drilling is ongoing, the saver sub will rotate in the drilling direction to rotate the drilling bit at the drilling face and the drill unit will advance the drill string into the hole as the drilling continues.

After the drilling has been completed, each individual section of pipe must be removed from the drill string as the drill string is withdrawn from the borehole. In the present invention, the saver sub 16 is moved to the position within the drill unit so that the wrench mounted on the drill unit can be secured to the upper end of the next section of drill pipe in the drill string to which pipe 14 is secured.

Figure 5:
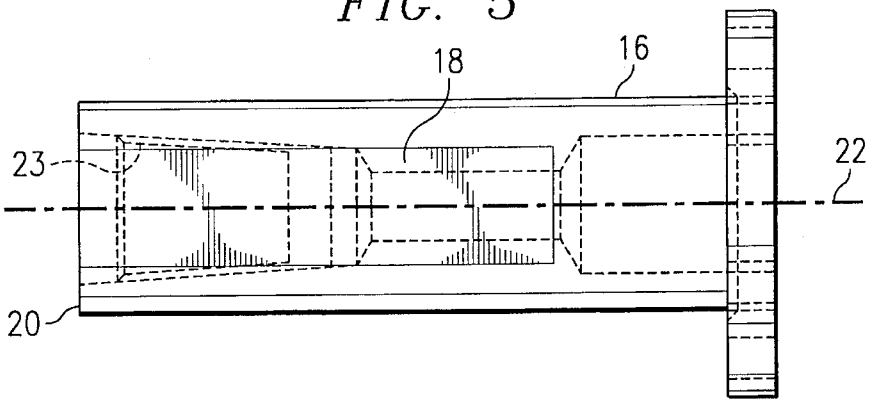
FIG. 5 is a top view of the saver sub showing the flats of the saver sub in plan view.
Figure 6:
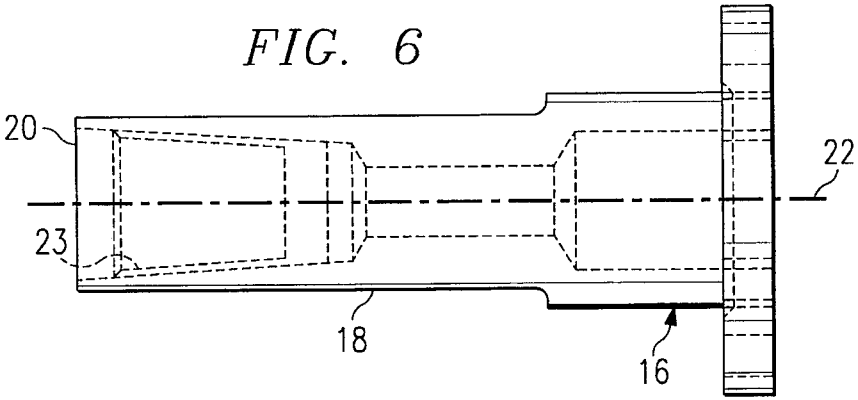
FIG. 6 is a side view of the sawer sub showing the flats of the saver sub in a side view.

As seen in FIGS. 5 and 6, the saver sub 16 has a pair of opposed flats 18 which extend from the front end 20 of the saver sub along a portion of its length. The flats are formed 180° apart from each other on opposite sides of the axis of rotation 22. The threaded portion 23 of saver sub 16 receives and threads to the pipe 14.

Figure 3:
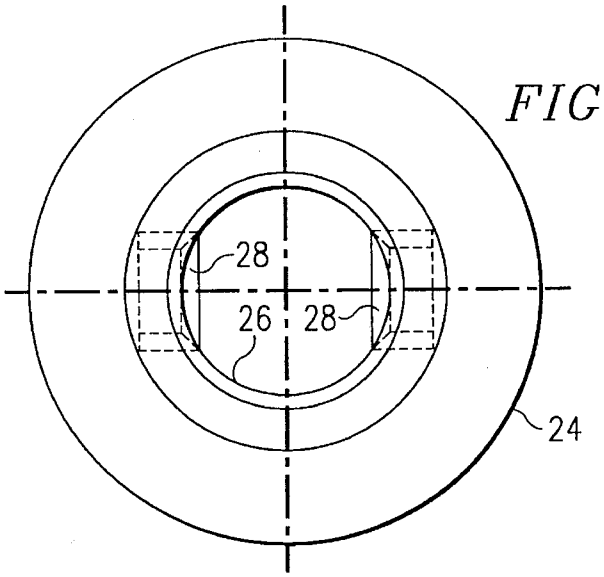
FIG. 3 is a end view of the slidable collar forming a portion of the present invention.
Figure 4:
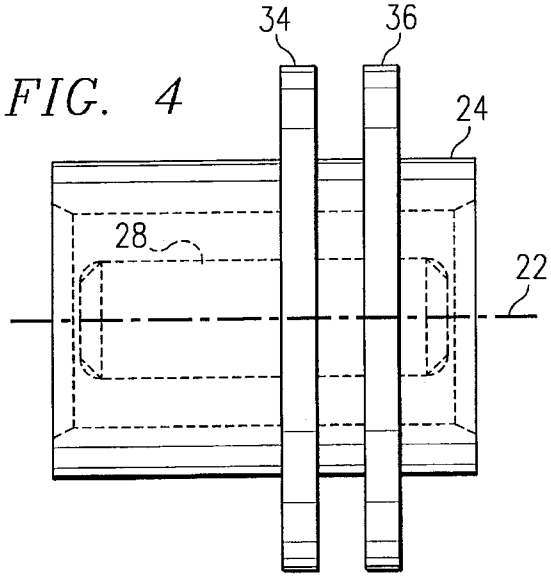
FIG. 4 is a top view of the slidable collar.

A slidable collar 24, seen in FIGS. 1, 3 and 4, has a through bore 26 permitting the collar to be slid over the front end of the saver sub 16. Inwardly facing lugs 28 on the collar 24 extend from the bore and engage or slide along the flats 18 on the saver sub. The width of the lugs 28 is slightly more than the width of the flats 18, permitting the slidable collar 24 to slide along the saver sub 16 yet rotate with the saver sub.

Figure 2:
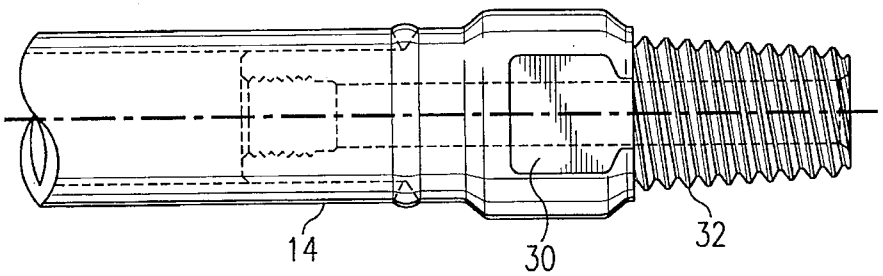
FIG. 2 is a side view of a drill pipe illustrating the flats thereon.

The drill pipe 14, as seen in FIGS. 1 and 2, can be seen to include opposed flats 30 formed at threaded end 32. When the slidable collar 24 is in the disengaged position, as seen in the upper portion of FIG. 1, the slidable collar 24 is completely out of contact with the drill pipe 14, permitting the drill pipe to be threaded into or threaded out of the saver sub 16. When the slidable collar 24 is moved into the engaged position, as shown in the lower part of FIG. 1, a portion of the lugs 28 slide over and engage the flats 30 on the drill pipe 14. Another portion of the lugs 28 remain in engagement with flats 18 on the saver sub 16. The slidable collar 24 therefore locks the saver sub 16 to the drill pipe 14 for joint rotation independent of the threaded connection between threads 32 and 23. When engaged, the drill pipe 14 is forced to rotate with the saver sub and the slidable collar.

A shift device, not shown, can engage the annular rings 34 and 36 on the slidable collar 24 to move the slidable collar between the disengaged and engaged positions. In operation, the drive unit is operated to move the pipe 14 into a position within the drill unit such that a wrench attached to the drill unit can be placed over the flats at the upper end of the pipe adjacent pipe 14. This will prevent the rotation of any part of the drill string other than pipe 14 itself relative to the drill unit. The saver sub 16 is rotated to break the connection between the drill pipe 14 and the saver sub 16 (but not unthread it completely). This threaded connection will almost always break first rather than the connection between pipe 14 and the adjoining pipe. The mechanism 10 is then extended into the locking position by moving the collar 24 in the direction toward the pipe 14 into the engaged position. It should be noted that a slight rotation of the saver sub may be required to align the lugs 28 with the flats 30. When this is accomplished, the mechanism 10 has locked the drill pipe 14 for rotation with the saver sub 16. The saver sub 16 is then rotated to break the connection between the drill pipe 14 and the adjoining drill pipe in the drill string and unthread drill pipe 14 entirely from the adjacent drill pipe, After unthreading this connection, slidable collar 24 is slid to the disengaged position, allowing the unthreading of the joint between the saver sub 16 and the drill pipe 14 to permit the drill pipe to be removed to storage. It should be noted that various methods may be employed to move the slidable collar 24 from the disengaged position to the engaged position and back. Furthers, while two lugs 28, flats 18 and flats 30 are shown to provide a better force balance, only one of each is necessary to perform the desired operation.

The use of flats at the upper end of each of the sections of drill pipe provides a positive lock between the mechanism 10 and the sections of pipe and eliminates scarring or marring on the drill pipe and insures that there will be no slippage once the mechanism and the drill pipe are engaged. Previous mechanisms, which use jaws, chucks or other clamping devices on round pipe, cause marking on the pipe and occasionally slip.

While one embodiment of the present invention has been illustrated in the drawings, and described in the foregoing detailed description, it will be understood that the invention is not limited to the embodiment disclosed, but is capable of numerous rearrangements, modifications and substitutions of parts and elements without departing from the spirit of the invention.

We claim:

1. A mechanism for locking a pipe in a drill string for rotation with the saver sub of a drill unit, the end of the pipe threaded to the saver sub, comprising:

a slidable outer collar mounted on the saver sub for movement between a first position and a second position, the saver sub having a flat formed thereon, the outer collar having at least one continuous lug formed thereon engaging the flat on the saver sub, the continuous lug engaging the flat on the saver sub as the slidable outer collar is moved between the first position and the second position, the end of the pipe having a flat thereon, the continuous lug of the slidable outer collar engaging the flat on the pipe when the slidable outer collar is moved to the first position to secure the pipe for rotation with the saver sub, the continuous lug being simultaneously in contact with the flat on the saver sub and the flat on the end of the pipe in the first position, the flats on the saver sub and pipe being in alignment when engaged by the continuous lug.

2. The mechanism of claim 1, wherein the slidable outer collar has opposed lugs, and the saver sub has opposed flats, each of the lugs being engaged on one of the flats, the pipe having opposed flats to receive the lugs in the first position.

3. The mechanism of claim 1 wherein the lug on the outer collar has a width and the flat on the pipe has a width, the width of the lug exceeding the width of the flat on the pipe.

4. A method for securing a pipe for rotation with the saver sub of a drill unit, the end of the pipe threaded to the saver sub, comprising the steps of:

moving a slidable outer collar between a first position and a second position, the outer collar having at least one continuous lug engaged on at least one flat on the saver sub for rotation therewith in both the first and second positions, the pipe having at least one flat, the continuous lug on the slidable outer collar moving into engagement with the flat on the pipe in the second position to secure the pipe for rotation with the saver sub;

rotating the saver sub and pipe relative each other until the flat on the pipe is in alignment with the flat on the saver sub, the continuous lug contacting both the flat on the pipe and the flat on the saver sub simultaneously when the slidable outer collar is in the second position.

5. The method of claim 4, further comprising the step of moving the outer collar from the first position to the second position, the outer collar having a pair of opposed lugs, the saver sub having a pair of opposed flats, each of the lugs sliding on one of the flats, the pipe having a pair of opposed flats, each of the lugs moving into engagement with one of the flats as the collar is moved into the second position.

* * * * *